US010086430B2

(12) United States Patent
Puy

(10) Patent No.: US 10,086,430 B2
(45) Date of Patent: Oct. 2, 2018

(54) METHOD FOR PRODUCING IRON METAL CASTINGS

(71) Applicant: HUPPERT ENGINEERING GMBH & CO. KG, Dautphetal (DE)

(72) Inventor: Hans-Peter Puy, Steffenberg (DE)

(73) Assignee: HUPPERT ENGINEERING GMBH & CO. KG, Dautphetal (DE)

( * ) Notice: Subject to any disclaimer, the term of this patent is extended or adjusted under 35 U.S.C. 154(b) by 9 days.

(21) Appl. No.: 15/508,248

(22) PCT Filed: Aug. 26, 2015

(86) PCT No.: PCT/EP2015/069509
§ 371 (c)(1),
(2) Date: Mar. 2, 2017

(87) PCT Pub. No.: WO2016/034467
PCT Pub. Date: Mar. 10, 2016

(65) Prior Publication Data

US 2017/0355015 A1 Dec. 14, 2017

(30) Foreign Application Priority Data

Sep. 4, 2014 (DE) ..... 10 2014 217 701

(51) Int. Cl.
*B22D 27/04* (2006.01)
*B22D 18/04* (2006.01)
*B22D 29/00* (2006.01)

(52) U.S. Cl.
CPC ..... *B22D 27/04* (2013.01); *B22D 18/04* (2013.01); *B22D 29/001* (2013.01)

(58) Field of Classification Search
CPC ..... B22D 27/04; B22D 18/04; B22D 29/001
See application file for complete search history.

(56) References Cited

FOREIGN PATENT DOCUMENTS

| | | |
|---|---|---|
| DE | 199 32 116 A1 | 1/2001 |
| DE | 10 2010 051 348 B3 | 11/2011 |
| DE | 10 2010 035 440 A1 | 3/2012 |

(Continued)

OTHER PUBLICATIONS

First Notification of Office Action, counterpart Chinese Application No. 201580047050.8, date of issuance: Jun. 15, 2018.

*Primary Examiner* — Kevin P Kerns
*Assistant Examiner* — Steven S Ha
(74) *Attorney, Agent, or Firm* — Hudak, Shunk & Farine Co., LPA

(57) ABSTRACT

A method for producing iron metal castings, wherein an expendable mold having a cavity for holding casting material is inserted into an opened multi-part permanent mold, the permanent mold is closed, the cavity is filled with casting material, wherein a supporting device partially protruding into the cavity is partially overcast, the expendable mold is cooled in the permanent mold after the filling, the permanent mold is opened during the cooling, after the liquidus temperature has been fallen below at the earliest, and the expendable mold is nondestructively removed from the permanent mold together with the casting, the expendable mold is further cooled together with the solidified casting while hanging on the supporting device, at least until the microstructure formation of the casting is concluded, the casting is demolded by removing the expendable mold.

20 Claims, 8 Drawing Sheets

(56) References Cited

FOREIGN PATENT DOCUMENTS

| | | | | |
|---|---|---|---|---|
| EP | 0 760 723 | B1 | 3/1999 | |
| EP | 1 131 175 | B1 | 1/2005 | |
| JP | 59-097740 | S | 6/1984 | |
| JP | 5056606 | B2 | 10/2012 | |
| WO | WO 02/45884 | A2 * | 6/2002 | ..... B22C 1/00 |

* cited by examiner

METHOD FOR PRODUCING IRON METAL CASTINGS

FIELD OF THE INVENTION

The invention relates to a method for producing iron metal castings. Casting methods are typically distinguished according to their type of production, distinguishing in particular between casting in an expendable mold and casting in a permanent mold, such as chill casting and pressure die-casting. The method according to the invention combines the two casting techniques by employing an expendable mold with a cavity to hold the casting in an opened multipart permanent mold. Such a combination of an expendable mold with a permanent mold is also basically known. For example, refer to the documents EP 1 131 175 B1 and DE 10 2010 035 440 A1.

BACKGROUND OF THE INVENTION

EP 1 131 175 B1 deals with a method and a device for the casting of iron in a permanent mold, whose inner walls are in contact with a mold of hardening molding material or greensand. After the mold has been placed into the permanent mold, the side pieces of the permanent mold are closed and subjected to a variable pressing pressure by means of a pressure mechanism. The permanent mold is cooled by means of a cooling mechanism after the melt has been introduced. For this, it is proposed to control the cooling rate during the entire cooling process, until the perlite transformation has been concluded, so as to ensure the desired mechanical properties of the casting. Moreover, it is proposed to increase the cooling rate in the phase of the perlite transformation by opening the permanent mold, whereupon the resulting air cooling increases the cooling rate and results in greater strength of the casting. Alternatively, it is proposed to decrease the cooling rate by opening the permanent mold when the temperature of the casting is in the austenite region. For this, the cast piece should be embedded in an insulating medium or covered with such immediately after the opening and held in this state until the temperature of the cast piece has fallen below the perlite transformation temperature.

DE 10 2010 035 440 A1 proposes, for a better control of the cooling of the cast piece, to provide between the inner wall of the permanent mold and the outer wall of the expendable mold (sand mold) at least one space with coolant flowing in it or a coolant channel arranged in a spiral about the sand mold.

SUMMARY OF THE INVENTION

The following invention makes use of this or a comparable device consisting of an expendable mold and a permanent mold enclosing this expendable mold. Starting from this premise, the problem which the present invention proposes to solve is a more efficient and flexible organization of the method for production of metal castings.

The problem is solved by a method for producing iron metal castings with the features of: an expendable mold having a cavity for holding casting material is inserted into an opened multi-part permanent mold, the multi-part permanent mold is closed, the cavity of the expendable mold is filled with casting material, wherein a supporting device partially protruding into the cavity of the expendable mold is partially overcast with the casting material, the expendable mold is cooled in the permanent mold after the filling, the multi-part permanent mold is opened during the cooling after falling below the liquidus temperature, preferably after falling below the solidus temperature, and especially preferably before the casting has reached the eutectoid transformation temperature, and the expendable mold is nondestructively removed from the opened permanent mold together with the casting, the expandable mold is further cooled while hanging on the supporting device, at least until the microstructure formation of the casting is concluded, the casting is demolded by removing the expendable mold.

The expendable molds are made from sand, especially chemically bonded casting sand, in conventional manner, such as the Croning, cold box, hotbox, furan, or water glass $CO_2$ methods, and shall also be termed hereafter a sand mold or core pack.

By iron metal casting is meant castings of any iron-carbon compounds, regardless of the carbon content, i.e., casting irons and steels. By casting material in the sense of this text is meant the melt of the iron metal casting. Once this is (at least partially) solidified, one speaks of a casting or cast piece.

The permanent mold is preferably a metallic permanent mold, such as one made of steel, casting iron, or brass, but it can also consist of another permanent mold material, such as graphite.

The fundamental difference between the method of the invention for the production of iron metal castings and the known methods is a two-stage cooling and demolding process. A first cooling (first cooling stage) of the casting at least until falling below the liquidus temperature, preferably until falling below the solidus temperature and preferably even before the casting has reached the eutectoid transformation temperature occurs in the mold still inside the permanent mold. The preferred lower temperature limit to which the casting in the core can be cooled in the first cooling stage can be indicated as being 723° C. For this, one will advantageously employ the device as described in DE 10 2010 035 440 A. Accordingly, the method of the invention preferably calls for the expendable mold to be cooled by a coolant flowing through a cavity arranged between the inner wall of the permanent mold and the outer wall of the expendable mold. This step shall also be called the "primary cooling" in the following. The coolant is preferably air or an inert gas. The cavity can be formed in the mold by one or more cooling channels arranged in a spiral about the mold. The cooling process is preferably done in a regulated or controlled manner and begins preferably after the filling of the mold. In exceptional cases, it can also start during the mold filling. The casting temperature of the expendable mold in the latter case is measured during the cooling, prior to the removal of the permanent mold, preferably on the suspension. This can be done in a noncontact manner, such as optically by means of infrared camera, or by means of heat sensors. Besides a temperature-regulated coolant flow, this can also be time, mass, and/or modulus controlled (i.e., in dependence on the surface to volume ratio, also called the solidification ratio), by determining in advance the coolant requirement for a predetermined cooling rate (mathematically) and programming the coolant flow accordingly.

The desired material properties (strength, hardness, ductility, etc.) as we know are adjusted by selecting the carbon content, the alloyage composition, and cooldown programs which are adapted each time in dependence on the individual microstructure transformation temperatures. In this, the removal of the unit consisting of the mold and the casting from the permanent mold plays a critical role, ending the first cooling stage during the austenite formation or solidification or after its completion and initiating a second cooling stage. The time of the removal is accordingly not earlier than reaching the liquidus temperature. Taking into account the temperature gradient toward the walls of the casting, a superficial solidification has already taken place, lending a sufficient stability to the casting while the core of the casting may still contain portions of melt at that time. Preferably, one holds off on the removal until the casting has also reached the solidus temperature in the interior, but not longer than when the casting has reached the eutectoid transformation temperature in the core. The precise temperature will depend on the desired microstructure state (austenite, coarse/fine striated perlite, coarse/fine grained ferrite, etc.) and the chemical composition, the alloyage elements, especially the carbon fraction in the material.

Thus, the second cooling stage is initiated in dependence on the desired microstructure and the properties of the cast piece at the earliest when the casting has at least solidified partially, i.e., the austenite formation has commenced or been completed advantageously, and preferably before reaching the eutectoid transformation temperature (723° C.). For this, the permanent mold is opened and the mold with the solidified casting is removed from it in nondestructive manner. The mold remains intact surrounding the cast piece and thereafter acts as a heat insulating or regulating material. Thus, with no further action a uniform cooling is assured over the surface of the casting still enclosed in the mold, while the mold is exposed to the ambient conditions. Only at the end of the second cooling stage is the casting demolded.

For an effective and especially a uniform cooling of the casting in the second cooling stage, the mold should be designed in terms of the required cooling performance, i.e., in particular the wall thickness of the mold should be designed with consideration of the surface to volume ratio of the casting, the ambient conditions, and the desired material microstructure of the casting. By ambient conditions in this regard is meant for example the thermal conditions in a cooling space where the expendable mold including casting still hanging on the supporting device it taken and in which it is further cooled. In such a cooling space, constant thermal conditions and a rapid carrying away of the introduced heat can be adjusted by adequate circulation or adequate exchange of the coolant, preferably air or an inert gas once again. Preferably, the cooling is controlled or regulated under temperature monitoring of the mold and/or the casting. The casting temperature of the expendable mold is measured for this during the cooling after the removal of the permanent mold, once again preferably on the suspension. But this can also be done without contact, for example optically by means of infrared camera, or by means of heat sensors. The second cooling stage is ended when the desired target temperature is reached for removal of the casting from the core pack, the unpacking temperature of preferably <300° C., at which the temperature curve of the further cooling has no further influence on the microstructure formation.

A critical role, especially in the second cooling stage, is played by the free suspension of the mold with cast piece on the supporting device. On the one hand, this reduces the danger of damaging the expendable mold during its removal from the permanent mold. A damaging would expose the casting partly or entirely to the surroundings and result in an uncontrolled microstructure formation. On the other hand, the suspension as opposed to a recumbent transport allows the mold to be flushed uniformly with coolant on all sides, and thus increased the efficiency and uniformity of the cooling.

Preferably, the supporting device is inserted together with a feeder cap into the expendable mold, before the latter is placed in the opened permanent mold. Such a feeder cap with hanging device is known for example from the document DE 10 2010 051 348 A. The permanent mold can be prepared for the next casting operation immediately after the removal of the mold, i.e., it can be fitted with the next expendable mold, among other things. The method is therefore very efficient and cost-favorable, because for the same throughput a smaller number of permanent molds are required. The method is also very flexible and once again cost-favorable, because different casting products can be produced with the same permanent mold by using different expendable molds. Thus, the casting shop does not need to keep a lot of different permanent molds on hand. A cylindrical permanent mold shape is the most diversified for this.

Moreover, it is advantageous that the cavity of the expendable mold is filled with melt rising from the bottom. Especially preferred is a use of the low-pressure casting technique.

After the filling of the mold from the bottom, it can be closed advantageously by means of a gate valve.

This makes it possible to remove the permanent mold with the mold and the casting from the filling station after the filling, so that the filling station is once again ready for use in the filling of the next mold/permanent mold.

Especially preferably, the cooling of the expendable mold commences immediately after its closure by means of the gate valve.

One advantageous modification of the invention calls for casting gases to be evacuated during the filling of the cavity of the expendable mold with casting material through a cavity arranged between the inner wall of the permanent mold and the outer wall of the expendable mold.

The cavity for the primary cooling and the cavity for evacuating the casting gases is preferably the same. Thus, the cavity preferably has a dual function, as exhaust gas line during the casting and as coolant supply and drain for the casting and for the expendable mold during the first cooling stage of the casting. It is advantageous for the cavity to be easily connected to a closed air venting system, which specifically disposes of the exhaust gases before they can get into the surroundings. One can thereby avoid large-dimensioned exhaust hoods and corresponding conduit systems circulating a lot of secondary air.

Preferably in addition to the primary cooling of the expendable mold the permanent mold is also directly cooled after the filling, i.e., the permanent mold walls ("secondary cooling"). This is done in cooling lines provided specifically for this in the permanent mold wall, through which coolant likewise flows.

Another advantageous modification of the invention calls for the expendable mold to be held by means of partial vacuum in the permanent mold when it is inserted into the opened multipart permanent mold.

Especially preferably the expendable mold and the permanent mold comprise fitting elements, which are joined together when inserting the expendable mold into the opened multipart permanent mold, thus ensuring a defined position of the mold in the permanent mold. The interacting fitting elements are therefore also called a core bearing. The fitting elements and the partial vacuum holding technique can be combined, as will be explained hereafter with the aid of sample embodiments.

BRIEF DESCRIPTION OF THE DRAWINGS

There are shown.

DETAILED DESCRIPTION OF THE INVENTION

Figure 1:
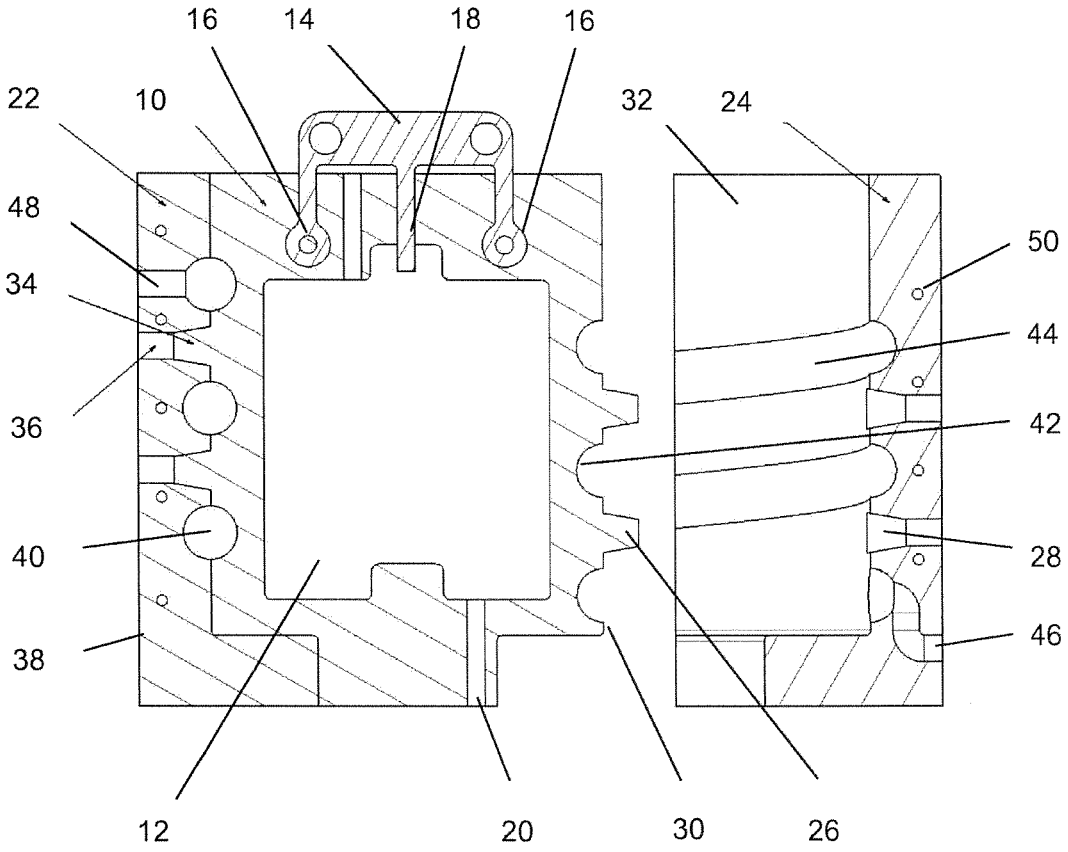
FIG. 1, a first embodiment of an expendable mold during its placement in the permanent mold.

FIG. 1 shows an expendable mold 10 with a cavity 12 for the holding of casting material. The cavity 12 has an inner surface, which mirrors the outer contour of the cast piece being produced. The expendable mold 10 consists of a preferably chemically bonded mold sand, forming a naturally stable structure.

In the mold 10 there is fixed a supporting device 14 by means of two first anchor elements 16. The supporting device is thus already sufficiently connected to the mold 10 in order to bear its own weight. The supporting device moreover has a second anchor element 18, which projects through the wall of the mold 10 into the cavity 12 so that it can be partly overcast with the casting material afterwards.

The later filling of the cavity 12 in the expendable mold 10 occurs in conventional manner through one or more gates 20, which preferably emerge into the cavity 12 from the bottom, so that the cavity 12 of the expendable mold can be filled with casting material ascending from the bottom, especially preferably in the low-pressure casting technique.

The expendable mold 10 prior to the filling with casting material in the manner shown in FIG. 1 is at first inserted into a first part, here a first half 22, of an opened multipart permanent mold, before the permanent mold is closed by assembling its second half 24 with the first half 22. In order for the expendable mold 10 to be at first fitted exactly in the first half 22 of the permanent mold and then after the closing of the permanent mold also received in the second half 24 of the permanent mold, both the expendable mold 10 and the halves of the permanent mold 22, 24 have fitting elements 26 and 28, which are designed to be complementary to each other. The fitting elements of the expendable mold 10 are designed as several lugs 26 projecting circumferentially from an outer wall 30 of the mold 10. For this, the permanent mold halves 22, 24 have complementary recesses 28 in their inner walls 32. The interacting fitting elements 26 and 28 form the so-called core bearing 34.

The permanent mold halves 22, 24 furthermore have connection channels 36 between the recesses 28 on the one hand and an outside 38 of the permanent mold halves 22 and 24. The connection channels 32 can be connected on the outside 34 to a suction line (not shown), so that a partial vacuum can be generated between the inner wall 32 and the outer wall 30. In this way, the mold 10 is pulled by its projections 26 into the recess 28 of the permanent mold half 22 and held there by the persistent partial vacuum until the permanent mold is closed. After this, the partial vacuum is no longer needed and the suction line can be removed or the partial vacuum deactivated.

Of course, the connection 32 can also be applied at another place of the boundary surface between the expendable mold 10 and the multipart permanent mold, so that the fitting elements and the connection channels for the partial vacuum fixation are spatially separated from each other. In the manner shown, however, the fitting elements and the means for partial vacuum fixation are combined in advantageous fashion.

Between the inner wall 32 of the permanent mold and the outer wall 30 of the expendable mold 10 there is arranged a cavity 40 serving as a conduit for a coolant for the cooling of the expendable mold, i.e., the primary cooling. The cavity 40 as a circumferentially closed coolant line is formed at first when joining the expendable mold 10 and the permanent mold, since it is halfway formed in the outer wall 30 in the form of an open spiral or helical channel 42 and 44. Instead of an encircling cavity, several cavities can also be provided. Neither does this have to be arranged in spiral or helical manner encircling the expendable mold 10, but instead it can also be formed, for example, as a meandering or repeatedly intersecting gridlike one. The cavity 40 has at least two connection channels 46 and 48 to the outside of the permanent mold, so that these can be connected to a circulatory system or a supply system for a coolant.

As the means for a secondary cooling of the permanent mold walls, an additional conduit system 50 is provided in the permanent mold walls, which for its part is led to the outside by ports, not shown, and can be connected to a circulatory or supply system for a further coolant.

Figure 2:
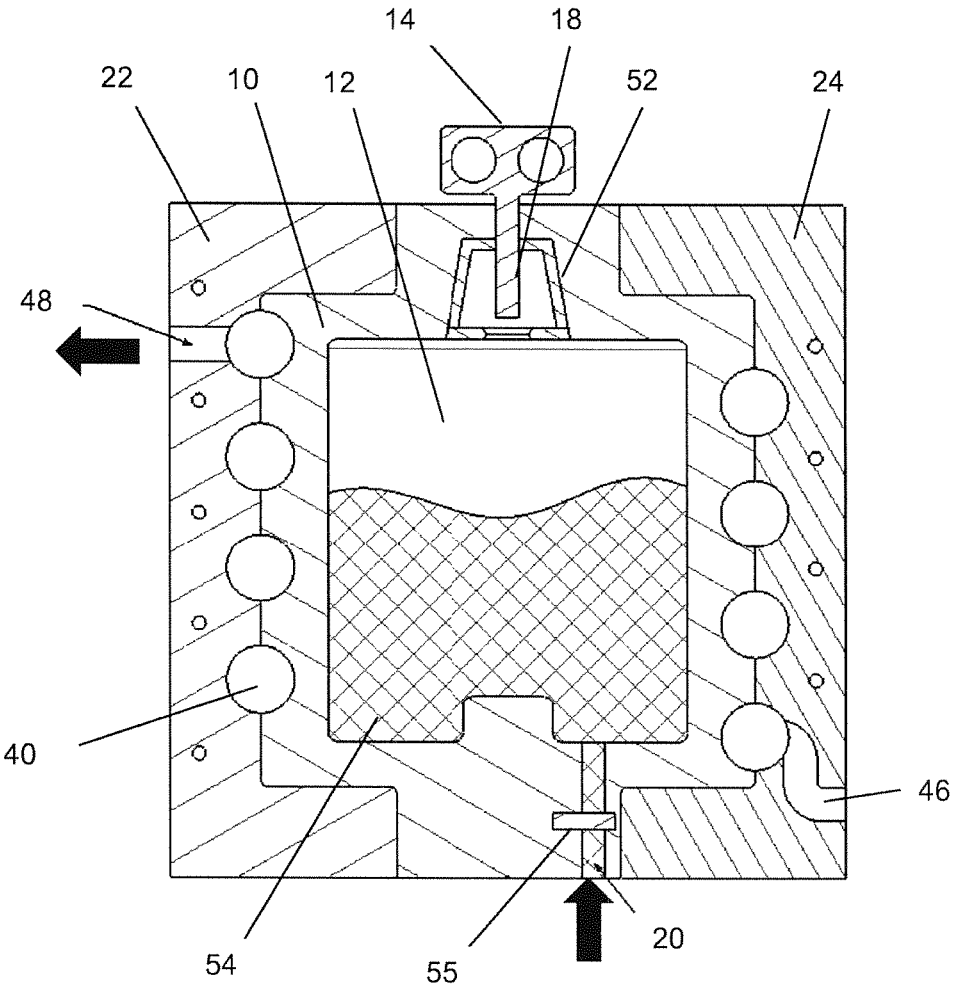
FIG. 2, an illustration of the filling step with the aid of a second embodiment of the combined expendable mold with permanent mold.

FIG. 2 shows the step of the filling of the cavity 12 of the expendable mold 10 with casting material 54. The casting material 54 is introduced from the bottom through the gate 20 into the cavity 12 of the expendable mold 10 after the permanent mold has been closed by joining the permanent mold halves 22 and 24. At the same time as the filling, casting gases in the cavity 12 are taken out through the porous structure of the sand mold 10 into the cavity 40 between the inner wall of the permanent mold and the outer wall of the sand mold 10 and led out from this through the connection channel 48 from the permanent mold. Merely as an example, the connection channel 48 is indicated here as an air vent channel. The connection channel 46 in this case is held closed for example by means of a plug or a valve (neither one shown). However, the casting gas can also be sucked out in the reverse direction through the connection channel 46 or at the same time through both connection channels 46 and 48.

In the embodiment shown here, the expendable mold 10 has, above the cavity 12 for the cast piece, a further cavity into which a feeder cap 52 has been previously installed, as is described in the document DE 10 2010 051 348 A. The feeder cap 52 serves to hold casting material 54 and has thermal insulating and/or exothermal properties so as to hold the enclosed casting material in the fluid state for a longer time, while it has already begun to solidify in the cavity 12. The volume shrinkage of the casting material 54 due to the solidification is thus compensated with the warmer and less viscous melt in the feeder cap 52.

Thanks to the use of a feeder cap 52, the supporting device 14 in this example is also designed different. It has an anchor element 18 engaging with the cavity of the feeder cap 52, which is connected sufficiently firmly to the feeder cap and/or the mold 10 so as to bear their natural weight. After the introduced casting material 54 has solidified around the anchor element 18, the load will be borne also or even predominantly by the resulting connection and the cast piece can be held with the mold 10 on the supporting device. At the end of the filling step shown in FIG. 2, the gate 20 is closed by means of a gate valve 55, so that the permanent mold with the expendable mold can be removed from the filling station.

Figure 3:
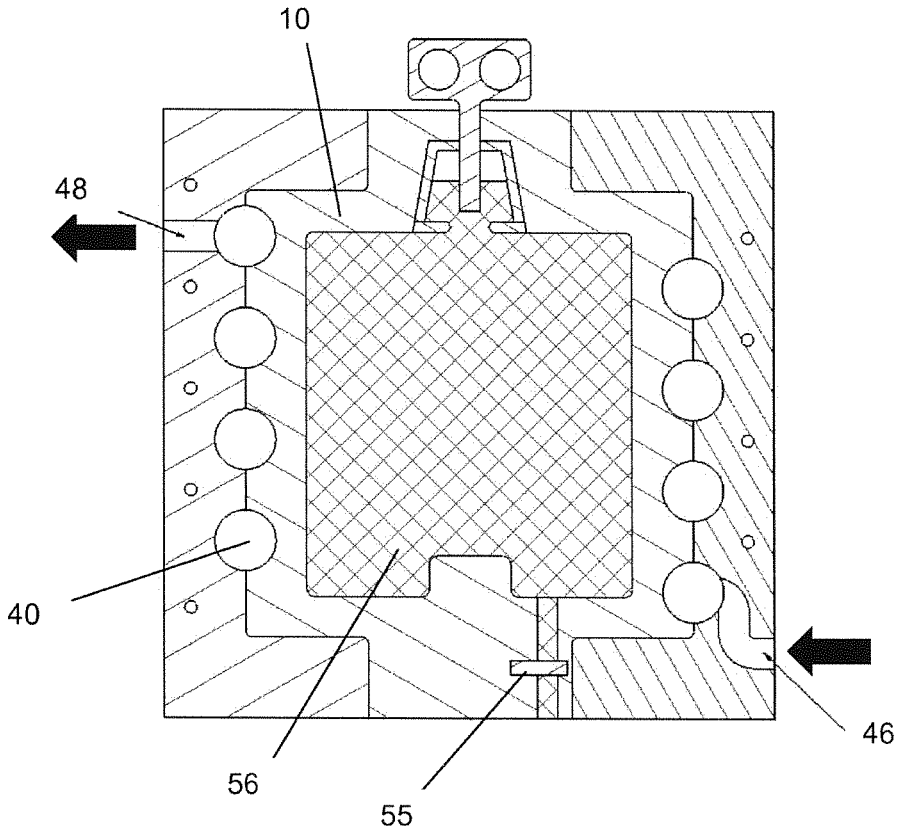
FIG. 3, an illustration of the primary cooling of the combined expendable mold with permanent mold.

FIG. 3 shows the step of the cooling of the expendable mold 10 in the permanent mold after the filling, i.e., it illustrates the primary cooling. This step starts preferably after the closing of the expendable mold 10 by means of the gate valve 55, so that the solidification of the casting material does not start already during the filling. For the purpose of the cooling, a coolant is introduced through the already described connection channel 46 into the cavity 40 and then led out from this through the connection channel 48, whereby heat is carried away from the expendable mold 10. So that the cavity 40 can easily perform the dual function of an exhaust gas line during the casting illustrated in FIG. 2 and as a supply and drain of coolant during the primary cooling step illustrated in FIG. 3, a valve is preferably provided in each of the supply lines (not shown) to the connections 46 and 48. Thus, the supply lines can be optionally either closed or connected to coolant lines or to exhaust gas lines. The primary cooling is carried out until the casting is at least partly solidified and the cast piece 56 has a stable structure. Depending on the desired microstructure of the product being produced, the primary cooling and thus the first cooling stage can also last longer. Basically, for reasons of efficiency, it is advisable to shut off the primary cooling with the removal of the mold and casting from the permanent mold a thus immediately with the ending of the first cooling stage.

Figure 4:
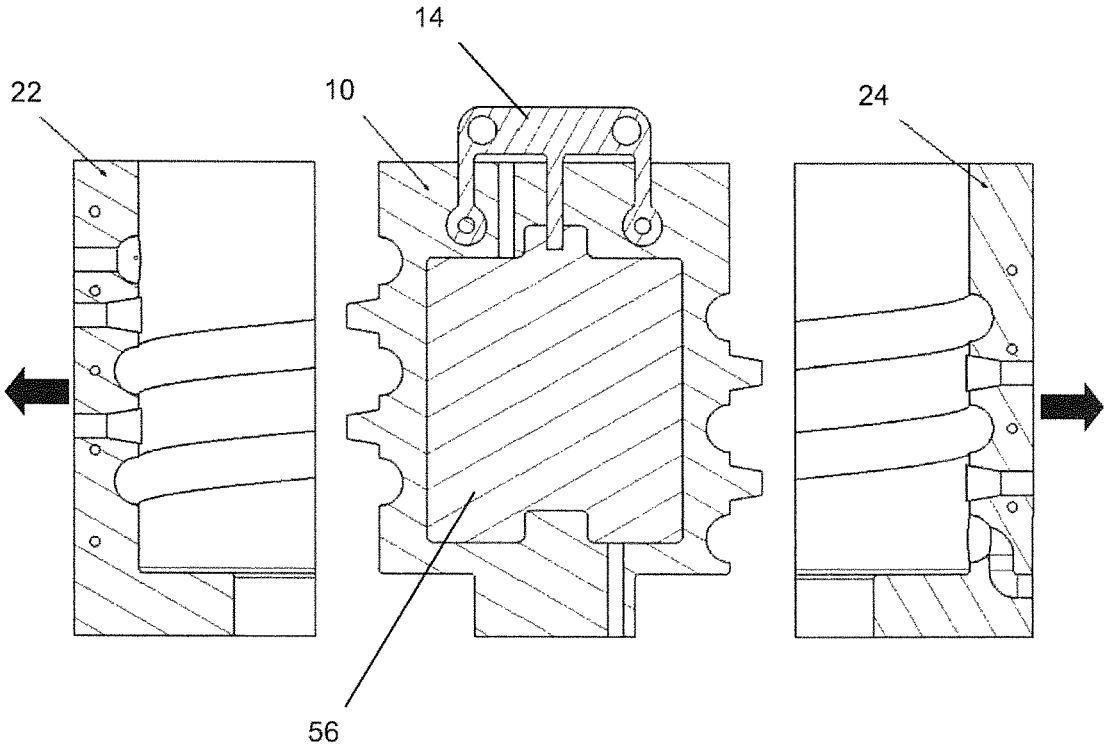
FIG. 4, an illustration of the opening of the combined expendable mold with permanent mold.

FIG. 4 shows the step of opening the permanent mold following the primary cooling. The two halves 22 and 24 of the permanent mold are moved apart, while the expendable mold 10 is held suspended from the supporting device 14. The supporting device 14 in the sample embodiment shown here corresponds to that shown in FIG. 1. Because the casting at this time is already partly solidified, especially at the surface, it has its own stability, so that the load of the mold and the casting is borne both by the connection of the supporting device 14 to the mold 10 and to the cast piece 56.

In this way, the mold is removed nondestructively from the permanent mold and taken to the second cooling stage. As described above, the mold 10 is thus transported for example to a cooling space in which it is further cooled down under regulated or at least controlled thermal conditions in desired manner until the casting temperature, preferably measured on the supporting device 14, has reached the present value, which is preferably the case when the desired unpacking temperature of 300° C., for example, has been reached or fallen below and the further cooling no longer has any influence on the microstructure and the properties of the cast piece.

Figure 5:
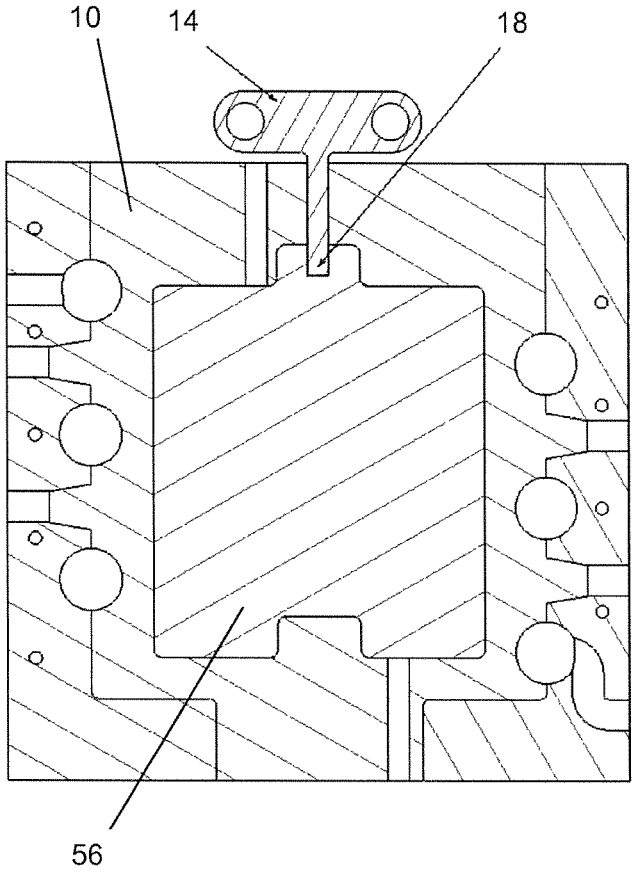
FIG. 5, a third embodiment of a combined expendable mold with permanent mold for use in the method according to the invention.

FIG. 5 shows the combined expendable mold 10 with permanent mold with an alternative configuration of the supporting device 14. This has been simplified as compared to the two above described supporting devices in that it has only a single anchor element 18, which extends through the expendable mold 10 as far as the cast piece 56. The anchor element 18 can be designed so that it is not suited to bear the mold 10 without the cast piece, so that this will be handled in a different manner when inserting it into the permanent mold. Alternatively, structures not shown (hooks or the like) can be provided along the surface of the anchoring element 18, producing an adequate connection with the sand mold 10 in order to withstand the tensile stress on the supporting device 14 when lifting and transporting the empty sand mold 10. The lower end of the anchor element 18 otherwise extends in the above described manner into the cavity of the sand mold 10, so that it is connected to the cast piece 56 after the solidification of the casting in the manner shown here and is able by this connection to bear the sand mold 10 together with the cast piece 56.

Figure 6:
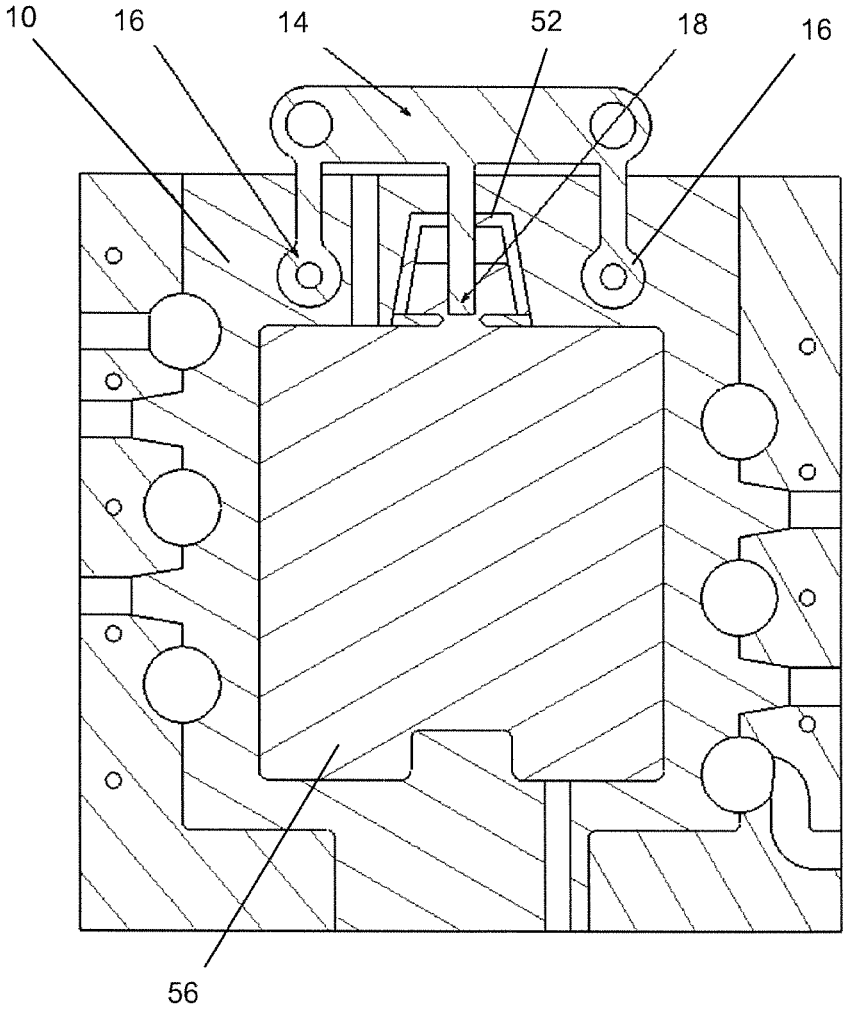
FIG. 6, a fourth embodiment of a combined expendable mold with permanent mold for use in the method according to the invention.

FIG. 6 shows another embodiment modified in regard to the supporting device 14 for a combined expendable mold 10 with permanent mold. The embodiment combines the first two anchor elements 16, which extend per the first embodiment of FIG. 1 into the sand mold 10, with a second anchor element 18 reaching through the sand mold 10, which extends per the second embodiment of FIG. 2 into the cast piece 56, and wherein a feeder cap 52 is provided that is integrated in the sand mold 10 and provides a cavity for the casting material.

Figure 7:
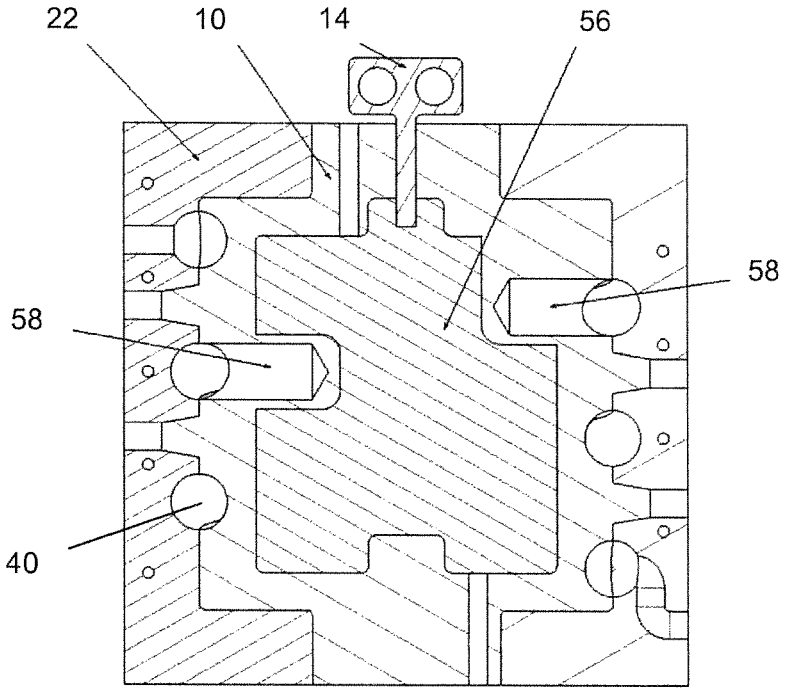
FIG. 7, a fifth embodiment of a combined expendable mold with permanent mold for use in the method according to the invention, and FIG. 8, a schematic representation of the sequence of the method according to the invention on a largely automated casting string.

FIG. 7 shows a fifth embodiment of a combined expendable mold 10 with permanent mold, which differs for example from the embodiment shown in FIG. 5 by additional blind hole borings 58 in the sand mold 10. The blind hole boring 58 in the mold 10 emerges into a section of the cavity 40 and thus enlarges its volume to receive a coolant. The arrangement of the blind hole borings 58 corresponds to sections of the sand mold 10 which have a larger wall thickness in order to bring up the coolant closer to the surface of the cast piece 56 in these places or to the boundary surface between the casting material and the mold 10 prior to solidification. Thanks to this provision, even with different wall thicknesses of the mold 10 a more uniform cooling of the surface of the casting or, when required, also a specifically accelerated cooling of the casting at desired sections of the surface can be achieved. Instead of the blind hole borings, through borings and/or channels can also be provided, which further accelerate the heat exchange or the cooling process at the corresponding sites or enable a more precise regulation. In particular, this makes possible a specific cooling of large local masses (heat centers) and/or a local optimization of the microstructure.

Figure 8:
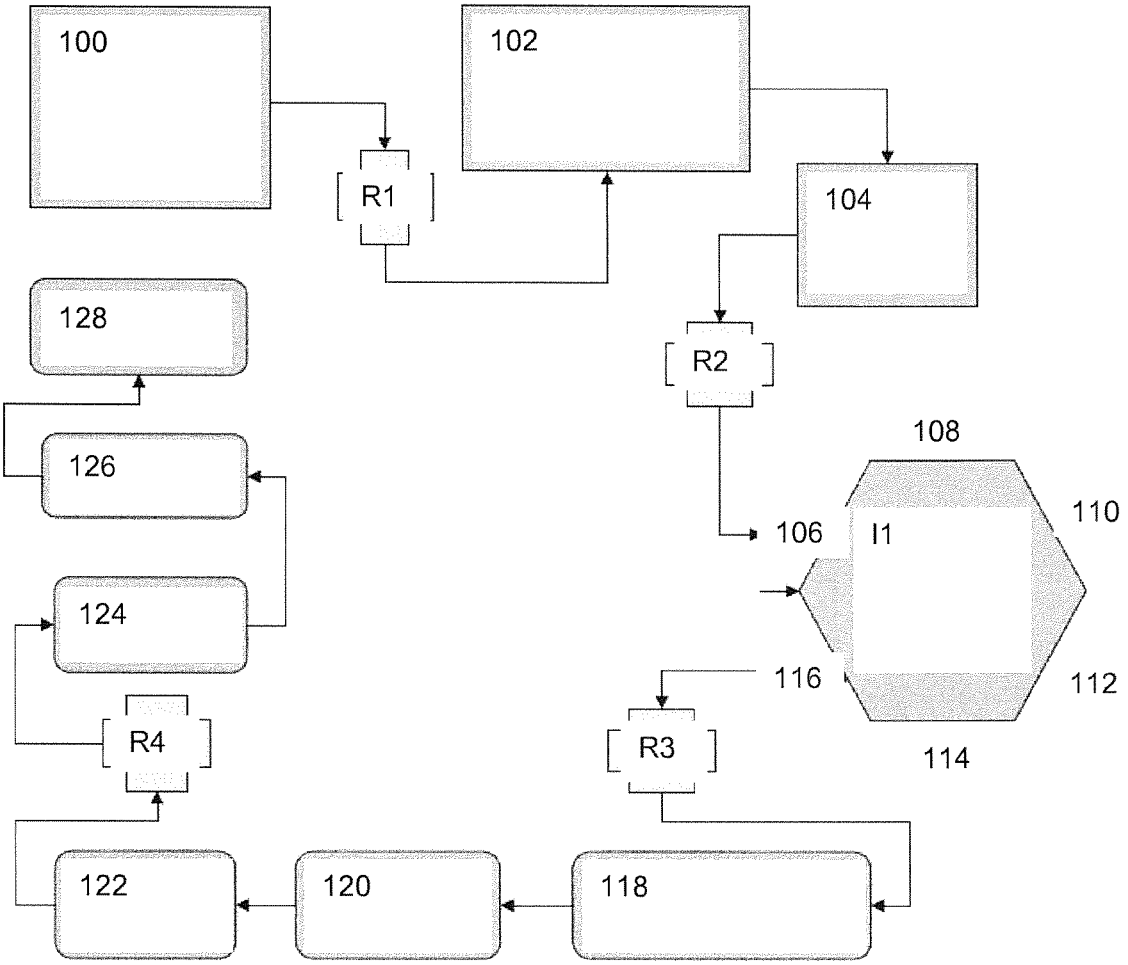

The flow chart in FIG. 8 shall now be used to explain the method of a particularly advantageous embodiment of the invention. The invention involves further steps which come before and after the actual casting process. It starts with a core production step 100, in which the expendable mold is produced for example in a cold-box process, a hot-box process, a Croning process, a furan resin process or a water glass $CO_2$ process as a preferably chemically bonded sand mold. This step 100 occurs preferably under optical monitoring and computer control.

Once the sand mold has been produced, it is handed over to the next station manually, semiautomatically, or fully automatically, preferably by means of a robot R1. At this station, the so-called core pack assembly 102 takes place. Several partial cores are assembled here into the core pack, of the expendable mold, such as are required for the casting. This step can also be supplemented when necessary with an additional core smoothing, e.g., by means of a spraying robot, depending on the demolding capability and surface quality requirements.

The core pack assembly 102 is optionally followed by the warehousing 104 of the core pack. It is kept in the warehouse awaiting call-up. Generally a certain number of core packs are kept on hand, depending on lot size, process speed, core production conditions and production process requirements, or there may be a just-in-time production under optimal core production conditions with no warehousing when the core production occurs just as quickly or more quickly than the work steps described in the following.

The core pack is taken from the core warehouse as needed and supplied to the next step of the method 106. Once again, the getting of the core pack is preferably done fully automatically by a robot R2.

The central module for carrying out the method according to the invention is a so-called production island I1, also known as a "carousel", on which at least 5, here 6, of the steps of the method which are essential to the invention are carried out. The first work step 106 at a first work station of the production island I1 is the inserting of the core pack into an opened multipart permanent mold and the closing thereof. This is done preferably in the manner described above with regard to FIG. 1.

Once the multipart permanent mold has been closed, the work station switches and in a work step 108 the cavity of the expendable mold is filled with casting material, preferably in the low-pressure casting technique. Once the filling is completed, the expendable mold is closed by means of a gate valve and it can then be taken on to the next work step 110. For this, the permanent mold again switches to the next work station, where the first cooling step, or the primary cooling of the mold, is done, optionally with the secondary cooling of the permanent mold at the same time or in succession. For this, the permanent mold, or more precisely the above described connection channels 46 and 48 are connected to a coolant system, preferably a coolant circuit. Moreover, the above described conduit system 50 in the walls of the permanent mold can be connected to a coolant system, preferably a coolant circuit, and the coolant system or systems placed in operation. The cooling processes of this work step 110 occur especially preferably in regulated manner under monitoring of the casting or permanent mold temperature. This can be measured, once again preferably, on the above described supporting device.

The cooling occurs in this embodiment over a total of three work stations, i.e., also in the work steps 12 and 114. During the entire primary cooling process the production island I1 thus moves on to two work positions, so that the previous work stations are available in the meantime to carry out the work steps 106 and 108. The ratio of the time it takes to insert the mold 10 into the permanent mold in step 106 and the filling time in step 108 to the duration of the primary cooling process (optionally with cooling of the permanent mold) determines the number of work stations reserved for the cooling process.

At the last work station of the production island, the permanent mold with the cooled expendable mold 10 undergoes work step 116, during which the multipart permanent mold is opened, at earliest when the casting is at least partly solidified, as described above. At the same time, the expendable mold hanging from the supporting device is removed from the opened permanent mold in the manner described above. Once again, this is done preferably by means of a robot R3 in fully automated fashion, in order to ensure a nondestructive removal of the expendable mold.

The robot R3 then hands off the expendable mold to a cooling line, in which it is further cooled, still hanging from the supporting device, step 118.

Once the casting enclosed in the expendable mold has finally reached the unpacking temperature of, for example, 300° C., with the desired microstructure, step 120 then occurs, in which the casting is finally demolded by mechanical removal of the expendable mold. This step is also called the "emptying" or "rough desanding".

After this comes a blasting 122 to remove sand residue from the casting. Once this process step is complete, the casting mold is taken, preferably by means of another robot R4 in fully automated fashion, to a separation station, involving the next step of separation 124 of the feeder and/or the supporting device. After this comes, in familiar manner, the final inspection 126 as well as the handover 128 to shipping or the parts warehouse.

LIST OF REFERENCE NUMBERS

10 Expendable mold, core pack
12 Cavity
14 Supporting device
16 First anchor element
18 Second anchor element
20 Gate
22 First permanent mold half
24 Second permanent mold half
26 Fitting element, lug
28 Fitting element, recess
30 Outer wall of mold
32 Inner wall of permanent mold
34 Core bearing
36 Connection channel
38 Outside of permanent mold
40 Cavity
42 Spiral or helical channel
44 Spiral or helical channel
46 Connection channel
48 Connection channel
50 Conduit system
52 Feeder cap
54 Casting material
55 Gate valve
56 Casting or cast piece
58 Blind hole boring
100 Core production
102 Core pack assembly
104 Core bearing
106 Insertion of the expendable mold and closing of the permanent mold
108 Filling
110 Cooling
112 Cooling
114 Cooling
116 Opening of the permanent mold and removal of the opened mold
118 Cooling of the expendable mold
120 Demolding of the cast piece
122 Blasting
124 Separation of the supporting device
126 Final inspection
128 Warehousing or shipping

What is claimed is:

1. A method for producing iron metal castings, comprising the steps of:

inserting an expendable mold having a cavity for holding casting material into an opened multi-part permanent mold, closing the multi-part permanent mold, filling the cavity of the expendable mold with casting material, wherein a supporting device partially protruding into the cavity of the expendable mold is partially overcast with the casting material, cooling the expendable mold in the permanent mold after the filling, opening the multi-part permanent mold during the cooling, at the earliest after falling below a liquidus temperature, or after falling below a solidus temperature, or before the casting has reached an eutectoid transformation temperature, and the expendable mold is non-destructively removed from the permanent mold together with the casting, further cooling the expendable mold together with the casting while hanging on the supporting device, at least until a microstructure formation of the casting is concluded, and demolding the casting by removing the expendable mold.

2. The method according to claim 1, wherein the supporting device is inserted together with a feeder cap into the expendable mold, before the latter is placed in the opened permanent mold.

3. The method according to claim 2, wherein the cavity of the expendable mold is filled with casting material rising from the bottom, wherein the cavity of the expendable mold is filled in a low-pressure casting technique, and wherein the expendable mold after being filled with casting material is closed by a gate valve.

4. The method according to claim 3, wherein the permanent mold with expendable mold and casting is transported away from the casting station after the closure, wherein the cooling of the expendable mold commences after the closure of the gate valve, and wherein the expendable mold is cooled by a coolant flowing through a cavity arranged between an inner wall of the permanent mold and an outer wall of the expendable mold.

5. The method according to claim 4, wherein the coolant flow is temperature regulated and/or cooled by mass, time and/or modulus, wherein the expendable mold and casting hanging from the supporting device are taken to a cooling space and further cooled therein, and optionally controlled or regulated under temperature monitoring, and wherein a casting temperature is measured during the cooling of the expendable mold on the supporting device before and/or after the removal of the permanent mold.

6. The method according to claim 5, wherein during the filling of the cavity of the expendable mold with the casting material, casting gases are evacuated by a cavity arranged between the inner wall of the permanent mold and the outer wall of the expendable mold, and wherein the permanent mold is cooled after the filling.

7. The method according to claim 6, wherein the expendable mold when placed in the opened multipart permanent mold is held in the permanent mold by a partial vacuum, and wherein the expendable mold and the permanent mold comprise fitting elements, which are joined together when inserting the expendable mold into the opened multipart permanent mold.

8. The method according to claim 1, wherein the cavity of the expendable mold is filled with casting material rising from the bottom.

9. The method according to claim 8, wherein the cavity of the expendable mold is filled in a low-pressure casting technique.

10. The method according to claim 8, wherein the expendable mold after being filled with casting material is closed by a gate valve.

11. The method according to claim 10, wherein the permanent mold with expendable mold and casting is transported away from the casting station after the closure.

12. The method according to claim 10, wherein the cooling of the expendable mold commences after the closure of the gate valve.

13. The method according to claim 1, wherein the expendable mold is cooled by a coolant flowing through a cavity arranged between an inner wall of the permanent mold and an outer wall of the expendable mold.

14. The method according to claim 13, wherein the coolant flow is temperature regulated and/or cooled by mass, time and/or modulus.

15. The method according to claim 1, wherein the expendable mold and casting hanging from the supporting device are taken to a cooling space and further cooled therein, and optionally controlled or regulated under temperature monitoring.

16. The method according to claim 1, wherein a casting temperature is measured during the cooling of the expendable mold on the supporting device before and/or after the removal of the permanent mold.

17. The method according to claim 1, wherein during the filling of the cavity of the expendable mold with the casting material, casting gases are evacuated by a cavity arranged between an inner wall of the permanent mold and an outer wall of the expendable mold.

18. The method according to claim 1, wherein the permanent mold is cooled after the filling.

19. The method according to claim 1, wherein the expendable mold when placed in the opened multipart permanent mold is held in the permanent mold by a partial vacuum.

20. The method according to claim 1, wherein the expendable mold and the permanent mold comprise fitting elements, which are joined together when inserting the expendable mold into the opened multipart permanent mold.

* * * * *